US005223900A

United States Patent [19]

Yuminamochi et al.

[11] Patent Number: 5,223,900

[45] Date of Patent: Jun. 29, 1993

[54] TRANSFER ROLLER WITH A RESISTANCE DETERMINED IN ACCORDANCE WITH ITS PERIPHERAL SPEED

[75] Inventors: Takayasu Yuminamochi; Koichi Tanigawa, both of Tokyo; Akihiko Takeuchi; Koichi Hiroshima, both of Yokohama, all of Japan

[73] Assignee: Canon Kabushiki Kaisha, Tokyo, Japan

[21] Appl. No.: 801,887

[22] Filed: Dec. 3, 1991

[30] Foreign Application Priority Data

Dec. 3, 1990 [JP] Japan ..... 2-400200

[51] Int. Cl.[5] ..... G03G 15/14

[52] U.S. Cl. ..... 355/273; 355/274

[58] Field of Search ..... 355/271, 273, 274, 277

[56] References Cited

U.S. PATENT DOCUMENTS 4,482,240 11/1984 Kuge et al. ..... 355/274
5,041,878 8/1991 Takai et al. ..... 355/273
5,075,731 12/1991 Kamimura et al. ..... 355/274

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus includes a movable image bearing member; a transfer device cooperative with the image bearing member to form a nip, through which a transfer material is passed to electrostatically transfer an image from the image bearing member onto the transfer material; where the resistance R range providing proper image transfer is determined in accordance with the equation:

$$-9.16\times10^3\times v+11.68-0.65\leqq\log_{10}(R\times L)$$

$$\leqq-9.16\times10^3\times v+11.68+0.65$$

where V (mm/sec) is movement speed of the image bearing member ($v\geqq40$), R (ohm) is a resistance of the transfer device when a voltage of 3 KV is applied between the image bearing member and the transfer device, and L (mm) is a length of the nip measured in a direction of a generating line of the image bearing member.

11 Claims, 4 Drawing Sheets

TRANSFER ROLLER WITH A RESISTANCE DETERMINED IN ACCORDANCE WITH ITS PERIPHERAL SPEED

FIELD OF THE INVENTION AND RELATED ART

The present invention relates to an image forming apparatus such as an electrophotographic copying machine or printer in which an image is transferred from an image bearing member to a transfer material by a transfer means such as an image transfer roller contactable to the backside of the transfer material.

In conventional image forming machines, the toner image formed on the image bearing member in the form of a photosensitive drum or a dielectric drum is transferred onto the transfer material such as paper by a transfer corona discharger. Recently however, an image transfer roller replacing the transfer corona discharger has been put into practice in consideration of its advantages that the transfer roller is effective to assure the stabilized contact of the transfer material to very little photosensitive drum and that the ozone is produced.

The transfer roller is provided with a core metal with an elastic layer thereon which is press-contacted to the photosensitive drum to form a nip, through which the transfer material is passed during the image transfer operation, while a voltage is applied between the photosensitive drum and the transfer roller so that the toner image is transferred from the photosensitive drum to the transfer material.

The transfer roller has been used with a laser beam printer having a relatively low process speed such as 25 mm/sec (the peripheral speed of the photosensitive drum during the image formation). In such a printer, a reverse development system is used in which such a part of the photosensitive drum as has the attenuated potential (right portion) receives the toner having been charged to the polarity which is the same as the charging polarity of the photosensitive drum. Therefore, the charging polarity of the photosensitive drum is opposite from the transfer charging polarity which is opposite to that of the toner.

The elastic layer of the transfer roller is made of foamed urethane material or rubber material such as EPDM (tercopolymer of ethylene, propylene and diene having dispersed carbon or metal oxide). The resistance of the transfer roller is intermediate such as $1.3\times10^9$ ohm (roller length: 210 mm).

FIG. 3 shows an example of a method of measuring the transfer roller 5. The transfer roller 5 press-contacted to an aluminum drum 19 at the pressure of 1.4 kg. Between the core metal 55 and the ground 20, the voltage of 3 KV is applied. The transfer roller 5 and the aluminum drum 19 may be rotated or not rotated. The resistance is calculated on the basis of the current measurement by the ampere meter 18. Prior to the measurement, the transfer roller 5 is kept at 20° C. and 60% relative humidity for not less than 8 hours, and the measurement is carried out under the same conditions. In this specification, the resistances are all those measured under such conditions. The resistance of the transfer roller 5 directly influences image transfer performance, but the resistance varies within a predetermined manufacturing tolerance. For example, it varies depending on the manufacturing lots. In the conventional examples, it varies in the range between approximately $2.9\times10^8$ ohm $-5.7\times10^9$ ohm. If the resistance of the transfer roller is within this range, good images can be provided. However, if the resistance is lower than the lower limit, the primary charging for the photosensitive drum becomes non-uniform depending on the presence or absence of the transfer material, with the result of so-called paper ghost. If the resistance exceeds the upper limit, improper image transfer results.

The non-uniformity results from the application of the transfer voltage to the transfer roller for the transfer operation between the longitudinal region of the photosensitive drum where the transfer material existed at the transfer position and the longitudinal region of the photosensitive drum where the transfer material existed, since the potentials are different between such regions. This will be described in more detail. The transfer voltage has the polarity which is opposite to the charging polarity of the photosensitive drum. In the transfer material absent region of the photosensitive drum where the photosensitive drum directly contacts with the transfer roller, the photosensitive drum is strongly charged by the transfer roller to the polarity opposite from the charging polarity. After the image transfer operation, this region of the photosensitive drum is not completely discharged electrically, even by the preexposure before the next image forming operation. Therefore, for the next image forming operation, the primary charge potential does not reach the predetermined level with the result of the non-uniform image.

In the case of the transfer roller 5 used, the contact between the transfer material and the photosensitive drum is stabilized, as compared with the conventional case using the transfer corona discharger, and therefore, the transfer material does not vibrate, and the image is stabilized. In addition, the production of ozone is at a minimum since the contact type charging not requiring the high electric field is used. Accordingly, it is desired that the transfer roller can be incorporated in a high process speed image forming apparatus, and the application of the transfer roller to the high speed field is tried.

When the contact type charging operation is used, the member to be charged moves while being processed by the charge application means, and member to be charged is electrically charged by the electric discharging in accordance with Paschen's law adjacent the inlet and output portion of the nip N provided by the contact between the member to be charged and the charge application member. From this understanding, the charging performance is not dependent on the speeds of the member to be charged and the charge application member.

As shown in FIG. 4, when the photosensitive drum 1 is driven at the peripheral speed v (m/sec), the transfer roller also rotates at substantially the same peripheral speed. The transfer material 12 also moves at the same speed v (m/sec). The contact charging occurs by the charge movement by the discharging adjacent the inlet and output of the nip N. The amount of charging is determined by the potential differences among the transfer roller 5, the transfer material 12 and the photosensitive drum 1, and is not influenced by the peripheral speed v. Thus, the transfer material 12 is always charged to a predetermined potential.

During the investigations by the inventors, it has been revealed that when the peripheral speed v of the photosensitive drum 1 is increased, the abovedescribed mechanism does not always apply from the standpoint of the image transfer performance. More particularly, when the peripheral speed v of the photosensitive drum is 25 (m/sec), the transfer roller 5 having the resistance ranging from $2.9\times10^8$ ohm $-5.7\times10^9$ ohm (from the central level of $1.3\times10^9$ ohm) have exhibited good transfer performance. However, when the peripheral speed v was increased to 40 mm/sec -200 mm/sec with the use of the same transfer roller, improper image transfer actions sometimes occurred. More particularly, when the core metal of the transfer roller 5 is supplied with approximately 3 KV, the transfer efficiency decreases when the peripheral speed v is increased, with the result that the final image on the transfer material had low image density.

SUMMARY OF THE INVENTION

Accordingly, it is a principal object of the present invention to provide an image forming apparatus in which the improper image transfer is prevented.

It is another object of the present invention to provide an image forming apparatus in which the image non-uniformity is prevented between the transfer material present portion and the transfer material absent portion.

It is a further object of the present invention to provide an image forming apparatus wherein the proper image transfer action is assured even when the process speed is high.

It is a yet further object of the present invention to provide an image forming apparatus wherein a production of the ozone is suppressed, and the high voltage is not required.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The embodiments of the present invention will be described in detail using the accompanying drawings.

Figure 1:
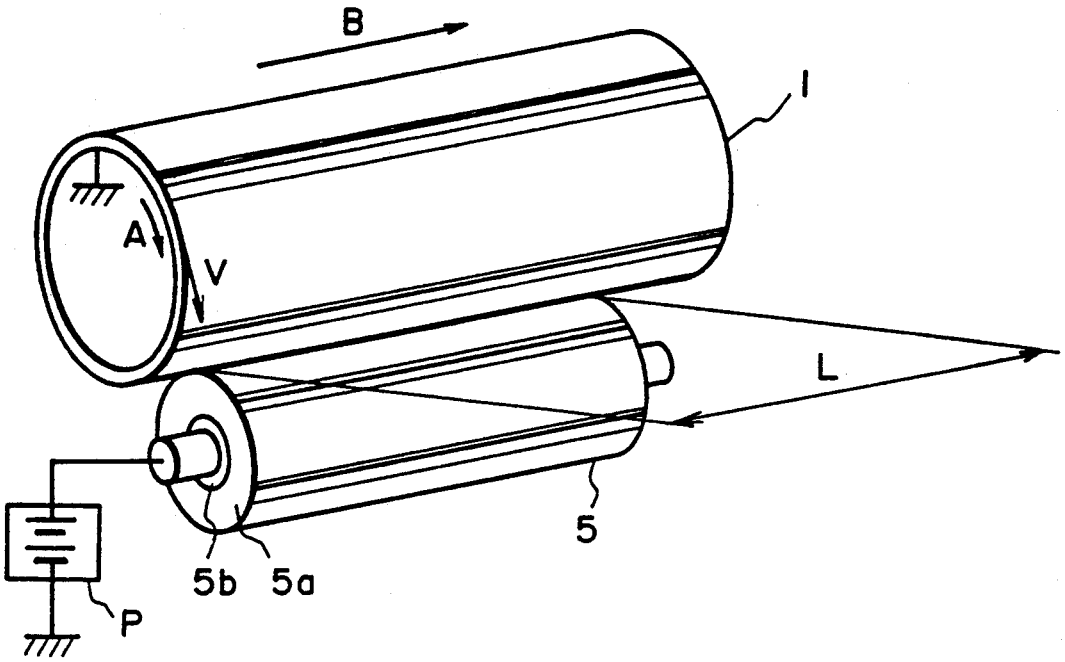
FIG. 1 is a perspective view of image transfer means applicable to an image forming apparatus according to a first embodiment of the present invention.
Figure 2:
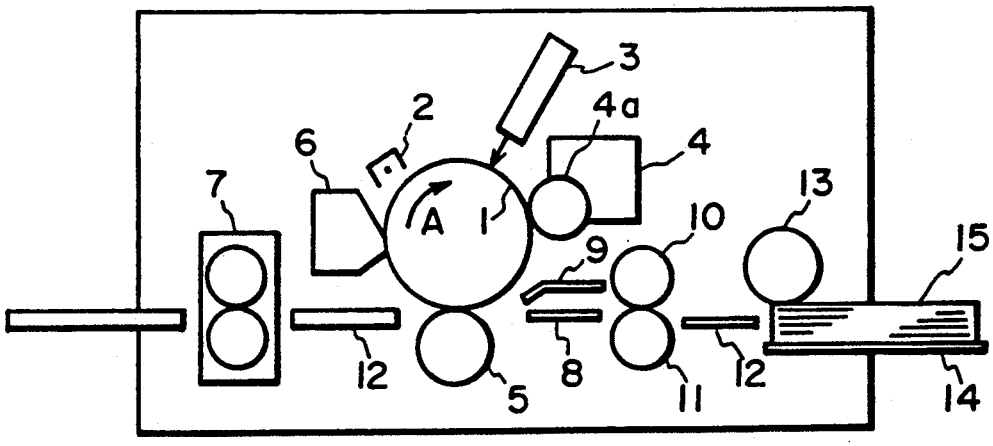
FIG. 2 is a side view an image forming apparatus according to an embodiment of the present invention.
Figure 3:
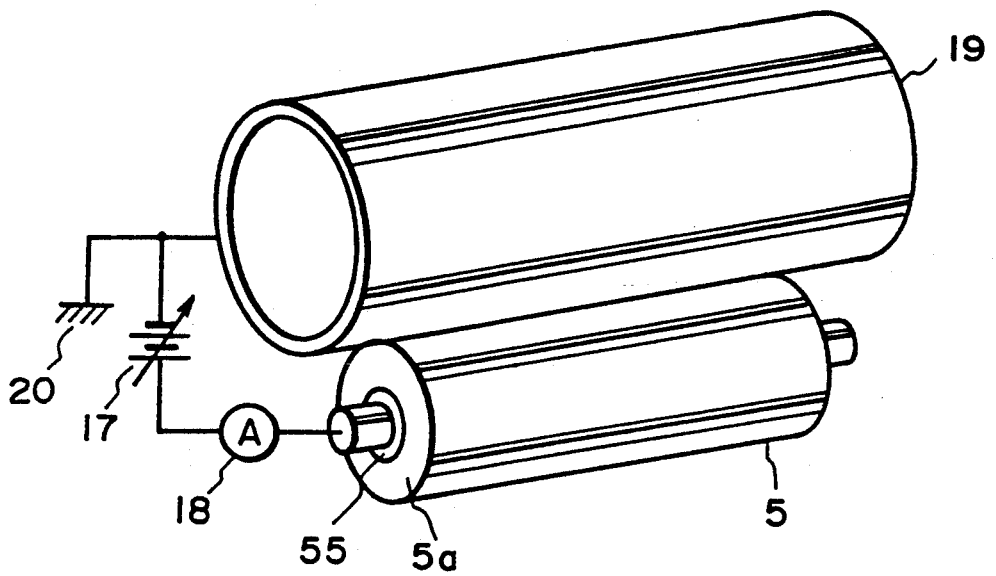
FIG. 3 is a perspective view illustrating the measurement of the resistance of the transfer roller.

Referring to FIGS. 1 and 2, there is shown an image forming apparatus according to an embodiment of the present invention.

A photosensitive drum 1 comprises an aluminum cylinder having a diameter of 30 mm and grounded, and an organic photoconductive material having a negative charging polarity on the aluminum cylinder. It is supported for rotation in the direction indicated by an arrow A. The photosensitive drum 1 is uniformly charged to the negative polarity by the primary charger 2 to provide a dark portion surface potential of $-700$ V. Thereafter, the photosensitive drum 1 is exposed to the beam from the light source 3 modulated in accordance with the image information, and the potential of the exposed portion attenuates to acquire the light portion potential of $-150$ V, so that a latent image is formed.

Figure 4:
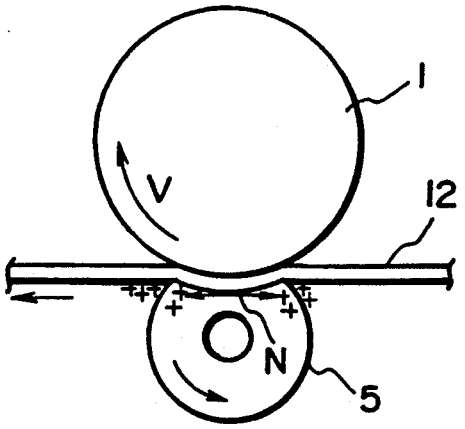
FIG. 4 is a side view illustrating the charging mechanism using the transfer roller.
Figure 5:
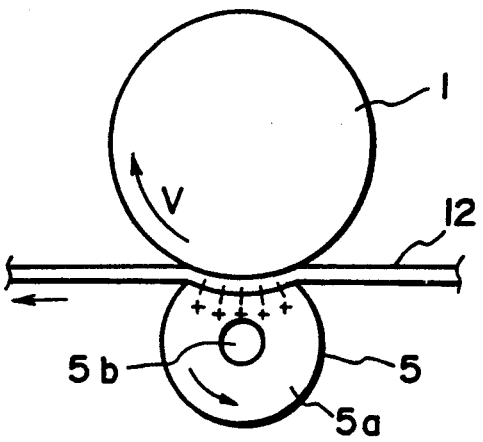
FIG. 5 is a side view illustrating the charging mechanism using the transfer roller.

A sleeve **4*a* of a developing device 4 carries toner in the form of a thin coating. The toner in this embodiment is one component magnetic toner, and has a volume average particle size of 6 microns. The toner has the amount of charge of approximately $-10$ microcoulomb/g. Since it has the electric charge of the same polarity as the primary charge, and therefore, at the position where the sleeve 4*a* and the photosensitive drum are closest, the toner is deposited on the light portion of the photosensitive drum 1, so that the latent image is visualized through the so-called reverse development process. Downstream of the developing device 4 with respect to the movement direction of the photosensitive drum 1, the transfer roller 5 is press-contacted to the drum 1. The visualized toner image on the photosensitive drum 1 is passed through a nip formed between the drum 1 and the roller 5. An image transfer roller (transfer means) 5 is supplied with a positive DC voltage, that is, a DC voltage having the polarity opposite from that of the toner, from a power source P, as shown in FIG. 1. By the transfer roller 5, the image is transferred from the photosensitive drum 1 onto the transfer material 12. The peripheral speed of the transfer roller is substantially the same as the peripheral speed of the photosensitive drum 1 in the nip. The transfer voltage is applied between the core metal 5*b* of the transfer roller 5 and the aluminum cylinder of the photosensitive drum 1. The transfer material 12 is accommodated in the sheet supply tray 14 in the form of a stack 15. The transfer sheets 12 are fed out one by one by a pick-up roller 13. The transfer sheet is further fed by registration rollers 10 and 11 in timed relation with the visualized image on the photosensitive drum 1. The transfer sheet is guided along transfer guides 8 and 9 to the transfer position where the photosensitive drum 1 and the transfer roller 5 are press-contacted. The transfer material 12 now receiving the toner image is conveyed to an image fixing device where it is fixed to a permanent or final image. The toner remaining on the photosensitive drum 1 without being transferred, is removed from the drum by a cleaning device 6, so that the photosensitive drum 1 is prepared for the next image forming operation. In the process of the image transfer action, it is considered that the charge is applied in the transfer nip N, as shown in FIGS. 4 and 5. The charging action shown in FIG. 4 occurs in accordance with the Paschen's law, and is not dependent on the peripheral speed v. The charging in FIG. 5** is proportional to the time period and is therefore dependent on the time required for passing through the nip N. Therefore, if the process speed is increased, the charging period decreases with the result that the amount of charge provided by the charging mechanism shown in FIG. 5 decreases. This is the cause of the decrease of the transfer performance.

In order to carry out the image transfer operation at a higher speed using the transfer roller 5 having the resistance of $1.3\times10^9$ ohm, it would be considered to increase the voltage applied to the core metal in an attempt to apply the proper amount of electric charge both in the charging mechanisms of FIGS. 4 and 5. However, the increase of the speed requires high voltage, and therefore, the required voltage is as large as 5–7 KV when the resistance of the transfer roller is near the upper limit ($5.7\times10^9$ ohm). Then, the elastic layer of the transfer roller 5 locally breaks down with the result of an improper image. In order to increase the bias voltage to the core metal of the roller, the high voltage source is required to have a large capacity, thus obstructing the reduction of the size and increasing the cost.

Figure 6:
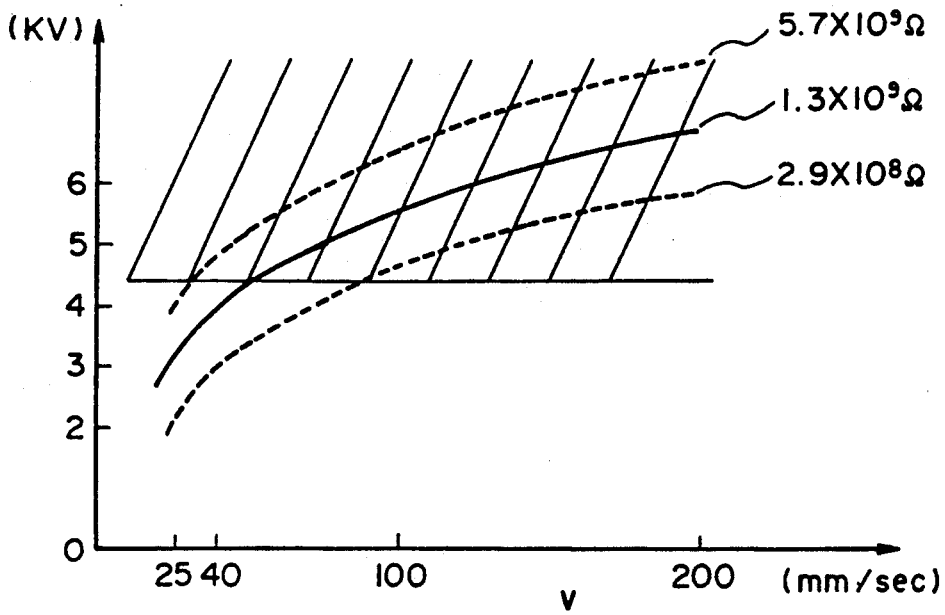
FIG. 6 is a graph showing a relation between the peripheral speed v of the image bearing member and the voltage applied to the transfer roller.

FIG. 6 shows the required voltage to be applied to the core metal so as to provide the same amount of electric charge on the transfer material when the conventional transfer roller having the resistance ranging from $2.9\times10^8$–$5.7\times10^9$ ohm is used with a high process speed machine ($v>40$). The hatched region indicates the occurrence of the improper image production attributable to the break-down of the elastic layer.

Figure 7:
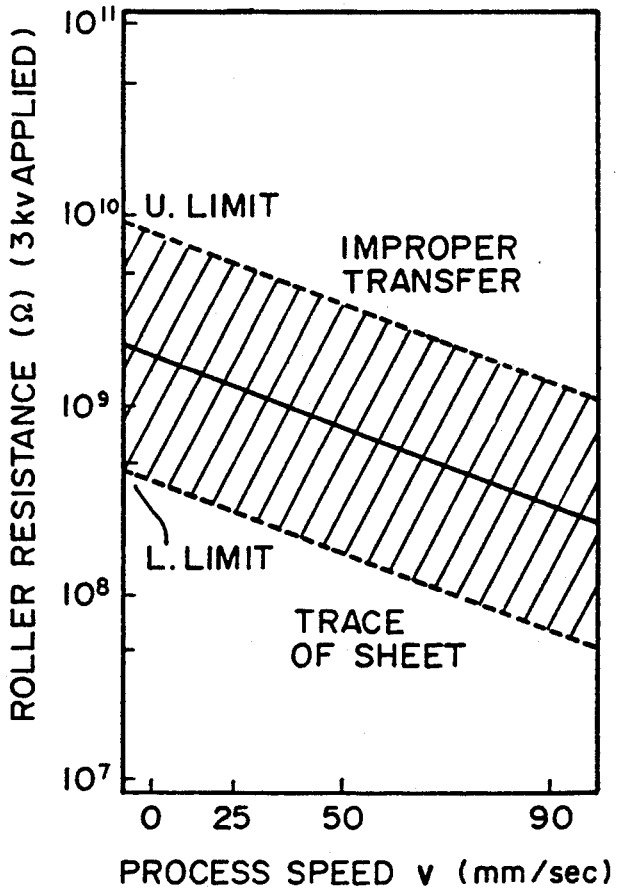
FIG. 7 is a graph showing a relation between the peripheral speed v of the image bearing member and the resistance R of the transfer roller.

In consideration of the above, the embodiment uses a novel transfer roller. The transfer roller 5 has an outer diameter of 20.0 mm, and the core metal **5*b* has a diameter of 8.0 mm. The elastic layer 5*a* has a thickness of 6.0 mm without pressure thereto. The transfer roller has a hardness of 30 degrees (Asker C). It is press-contacted to the photosensitive drum with the total pressure of 1.4 kg. The nip formed between the transfer roller 5 and the photosensitive drum 1, as shown in FIG. 1, has a nip width of 3 mm measured in the direction of the movement of the surface of the photosensitive drum, and the contact area has the length L of 220 mm in the direction of the generating line B of the photosensitive drum, that is, the longitudinal direction of the transfer roller. FIG. 7 shows a relation between the process speed of the photosensitive drum and the resistance of the transfer roller showing the results of numerous experimental tests by the inventors. The transfer roller had the basis weight of 60–135 g/m$^2$. It has-been found that the resistance R is preferably kept in the hatched region of FIG. 7 since then the voltage applied to the core metal 5*b* is low enough to prevent the occurrence of the break down under the condition that the transfer performance is enough without the image non-uniformity attributable to the presence or absence of the transfer material 12 (when the transfer current is too large). In the image forming apparatus of this embodiment, a transfer material having a length in the direction of the generating line of the photosensitive drum 1, which is smaller than the contact length L is usable. When such a transfer material is at the transfer position, there exists a portion where the photosensitive drum 1 and the transfer roller 5 are directly contacted. As will be understood from the experiments (FIG. 7), when the transfer operation is carried out at higher speed using the transfer roller 5, it has been found that if the peripheral speed v of the photosensitive drum 1 (mm/sec) increases, it is desirable that the resistance R (ohm) is smaller. The optical relation therebetween is, as shown in FIG. 7** by solid line $$\log_{10}(R)=-9.16\times10^{-3}\times V_{-3}+9.34 \quad \text{(a)}$$

The resistance R varies depending on the manufacturing tolerance, but the upper limit for not producing the improper image transfer and the lower limit for not producing the non-uniformity due to the presence or absence of the transfer material 12, are empirically determined, as indicated by the broken lines in FIG. 7:

$$\log_{10}(R)=-9.16\times10^{-3}\times v+9.34\pm0.65 \quad \text{(b)}$$

The above equation (b) was for the case of L=220 mm. For the transfer roller 5 having a length L:

$$\log_{10}(R)+\log_{10}(L)=9.16\times10^{-3}\times v+9.34\pm0.65+\log_{10}220$$

therefore, $$-\log_{10}(R\times L)=9.16\times10^{-3}\times v+11.68\pm0.65 \quad (1)$$

In other words, if the following is determined (hatched portion), the proper image transfer properties can be provided:

$$-9.16\times10^{-3}\times v+11.68-0.65\leqq\log_{10}(R\times L)\leqq-9.16\times10^{-3}\times v+11.68+0.65 \quad (2)$$

More specifically, and with reference to FIG. 7, the relationship between viscosity and resistance as set forth in the above equation (2) is derived from the equations (a) and (b) as follows:

Equation (a) corresponds to the solid line in FIG. 7, that is $$\log_{10}(R)=-9.16\times10^{-3}\times v+9.34$$

As will be understood from the broken lines in FIG. 7, the limits for providing the proper image transfer are obtained empirically as follows:

upper limit:

$$\log_{10}(R)=-9.16\times10^{-3}\times v+9.34-0.65$$

lower limit:

$$\log_{10}(R)=-9.16\times10^{-3}\times v+9.34-0.65 \quad \text{(b)}$$

The equation (b) is obtained from experiment in which L=220 ($\log_{10}L-\log_{10}220$), and therefore, when the length of L, the limits are upper limit:

$$\log_{10}(R)+\log_{10}L=-9.16\times10^{-3}\times v+9.34+0.65+\log_{10}220$$

lower limit:

$$\log_{10}(R)+\log_{10}L=-9.16\times10^{-3}\times v+9.34-0.65+\log_{10}220 \quad (1)$$

Since $\log_{10}220=2.34$, upper limit:

$$\log_{10}(RL)=-0.16\times10^{-3}\times v+11.68+0.65$$

lower limit:

$$\log_{10}(RL)=-9.16\times10^{-3}\times v+11.68-0.65 \quad (1)$$

The resistance R range providing proper image transfer (hatched lines in FIG. 7) is determined from equation (1), as follows:

$$-9.16\times10^{-3}\times v+11.68-0.65\leqq\log_{10}(RL)\leqq-9.16\times10^{-3}\times v+11.68+0.65 \quad (2)$$

For the process speed v=50 (mm/sec), an elastic layer 5a was made of EPDM rubber in which carbon and zinc oxide are dispersed in the form of a sponge layer, and the contents of the carbon and the zinc oxide were adjusted so as to provide the volume resistance of $8.3\times10^9$ ohm.cm (when 3 KV was applied), and the resultant resistance R was $7.6\times10^8$ ohm. The upper limit was $3.4\times10^9$ ohm, and the lower limit was $1.7\times10^8$ ohm. As for the method of adjusting the resistance R of the transfer roller 5 in accordance with the peripheral speed v of the photosensitive drum, the volume resistivity of the elastic layer 5a was made different. The following is a Table showing a relation between the photosensitive drum peripheral speed v and the volume resistivity of the elastic layer 5a produced in the manner described above. Here, the voltage actually applied to the transfer roller during the transfer operation is preferably 1.5–3.5 KV.

TABLE

| Peripheral Speed v of Drum | Vol. Resistivity of Elastic Layer |
|---|---|
| 40 mm/sec | $1.0\times10^{10}$ ohm |
| 90 | $3.5\times10^9$ |
| 150 | $1.0\times10^8$ |

As an alternative method, the same material may be used for the elastic layer 5a, and the desired resistance R is obtained by changing the thickness of the material. For example, for the process speed v=50 mm/sec, the resistance $R=7.6\times10^8$ ohm was provided with the thickness of 6 mm. If the thickness if reduced to 3 mm with the same material, the resistance $R=3.8\times10^8$ ohm, which is suitable for the process speed v=70 mm/sec. The method of changing the thickness of the elastic layer 5a is not preferable when the thickness is too large, since then the outer diameter of the transfer roller 5 is increased too much from the standpoint of accommodation in the apparatus. On the other hand, if the thickness if too small, the elasticity is lost, and therefore, the thickness change may be combined with the change of the material of the elastic layer 5a so as to provide the best transfer roller 5.

In the first embodiment described in the foregoing, the transfer roller 5 has a single elastic layer 5a. Another embodiment having an elastic layer 5a consisting of two or more layers.

Figure 8:
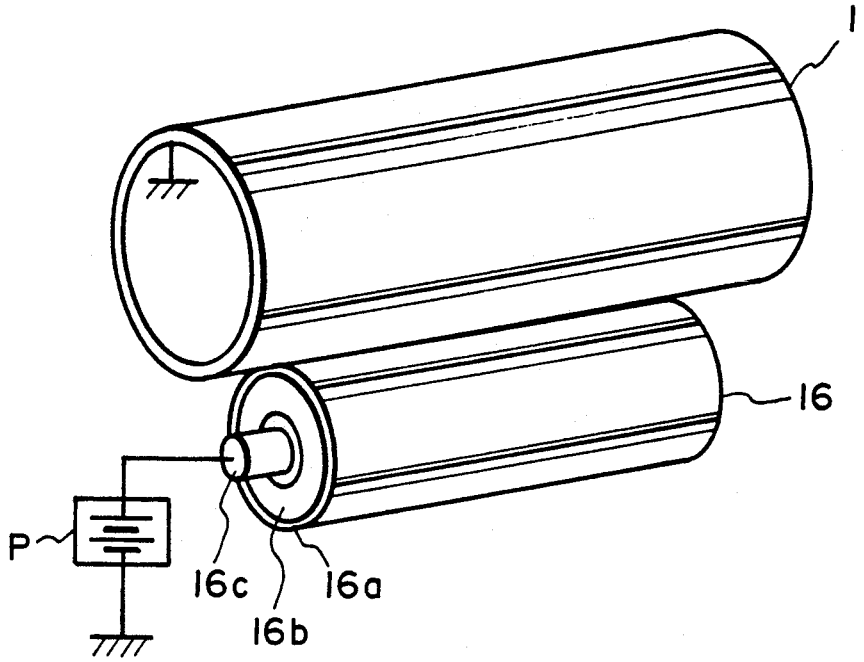
FIG. 8 is a perspective view of transfer means applicable to the image forming apparatus according to a second embodiment of the present invention.
Figure 9:
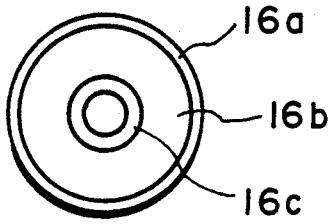
FIG. 9 is a side view of the transfer means shown in FIG. 8.

FIGS. 8 and 9 shows a transfer roller according to a second embodiment, which is applicable to the image forming apparatus of FIG. 2. In the FIGS. 8 and 9, the same reference numerals as in FIG. 2 have been assigned to the element having the corresponding functions for simplicity. The outer . diameter of the transfer roller, the diameter of the core metal, a nip width measured in the direction of the movement of the periphery of the photosensitive drum and the nip length measured in the direction of the generating line of the photosensitive drum are the same as in the case of the transfer roller shown in FIG. 1. The two layer transfer roller 16 has an intermediate resistance film layer 16a made of PVdF (polyfluorinated vinylidene), PET (polyethylene terephthalate) or the like and a conductive elastic layer 16b having such a small volume resistivity as compared with the intermediate resistance film layer 16a as is negligibly small. In this embodiment, it is made of chloroprene rubber or the like having the volume resistivity of $10^4$ ohm.cm approximately by incorporating of the carbon or the like. Designated by reference 16c is a core metal.

In this embodiment, the resistance R of the transfer roller 5 is substantially determined solely by the resistance of the intermediate resistance film 16a, and the volume resistivity of the intermediate resistance film 16a is changed in accordance with the peripheral speed v of the photosensitive drum. It is also possible to adjust the resistance of the transfer roller by changing the thickness thereof. For example, when the use is made with PVdF film having the volume resistivity of $5.0\times10^{11}$ ohm.cm, the thickness thereof is 100 microns for the process speed of 50 mm/sec, since then the resistance is $7.6\times10^8$ ohm similarly to the above-described case, and the thickness is 43 microns for the process speed of 90 mm/sec, since then the resistance is $3.3\times10^8$ ohm which is coincidence with the solid line portion of FIG. 7. In the case of the two layer structure of the elastic layer 5a, the hardness adjustment and the resistance adjustment of the transfer roller 5 are allotted to the respective layers, so that the selectable ranges are wider, and the hardness and the resistance can be separately designed.

In the foregoing embodiment, the transfer means has been in the form of a transfer roller, but it may be in the form of a transfer belt.

As described in the foregoing, according to the present invention, the resistance R of the transfer roller 5 is determined in accordance with the peripheral speed v of the transfer drum 1, and therefore, the transfer device does not produce the non-uniformity of the image or the improper image transfer attributable to the presence or absence of the transfer material 12, and does not produce the improper image attributable to the break-down of the intermediate elastic layer 5a attributable to the high voltage application to the core metal 5b. In addition, the high speed image transfer action is possible with a relatively low voltage applied, and therefore, the size of the high voltage source may be small with the lower cost.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

transfer means cooperative with said image bearing member to form a nip, through which a transfer material is passed to electrostatically transfer an image from said image bearing member onto the transfer material;

where the resistance R range providing proper image transfer is determined in accordance with the equation:

$$-9.16\times10^{-3}\times v+11.68-0.65\leqq\log_{10}(R\times L)\leqq-9.16\times10^{-3}\times v+11.68+0.65$$

where v (mm/sec) is movement speed of said image bearing member (v≧40), R (ohm) is a resistance of said transfer means when a voltage of 3 KV is applied between said image bearing member and said transfer means, and L (mm) is a length of the nip measured in a direction of a generating line of said image bearing member.

2. An apparatus according to claim 1, further comprising a power source for supplying electric power between said image bearing member and said transfer means during transfer operation of said transfer means.

3. An apparatus according to claim 1, wherein said transfer means is in the form of a rotatable member.

4. An apparatus according to claim 1 or 3, wherein said transfer means has an elastic layer.

5. An apparatus according to claim 1 or 3, wherein said transfer means includes a conductive elastic layer and a resistance layer having a volume resistivity larger than that of said conductive elastic layer.

6. An apparatus according to claim 1, further comprising latent image forming means for forming an electrostatic latent image on said image bearing member and developing means for developing the electrostatic latent image with toner.

7. An apparatus according to claim 1, wherein said latent image has a polarity which is opposite from that of a charging polarity of said transfer means.

8. An apparatus according to claim 7, wherein a charging polarity of the latent image is the same as a charging polarity of the toner.

9. An apparatus according to claim 7 or 8, wherein said image bearing member is a photosensitive member having an organic photoconductive layer.

10. An apparatus according to claim 1 or 3, wherein said transfer means is press-contacted to said image bearing member.

11. An apparatus according to claim 1, wherein said image bearing member is in the form of a drum.

* * * * *

UNITED STATES PATENT AND TRADEMARK OFFICE

CERTIFICATE OF CORRECTION

PATENT NO. : 5,223,900

DATED : June 29, 1993

INVENTOR(S) : TAKAYASU YUMINAMOCHI, ET AL.

It is certified that error appears in the above-indentified patent and that said Letters Patent is hereby corrected as shown below:

Title Page:

[57] Abstract

Lines 8-9, "$-9.16 \times 10^3 \times v + 11.68-0.65 \leq \log_{10}(R \times L)$ $\leq -9.16 \times 10^3 \times v + 11.68 + 0.65$" should read -- $-9.16 \times 10^{-3} \times v + 11.68-0.65 \leq \log_{10}(R \times L)$ $\leq -9.16 \times 10^{-3} \times v + 11.68 + 0.65$--.

COLUMN 1

Line 22, "very" should be deleted.

Line 23, "little" should read --the-- and "the" should read --very little--.

Line 26, "which" should read --and--.

COLUMN 2

Line 25, "preex-" should read --pre-ex- --.

Line 68, "abovedescribed" should read --above-described--.

COLUMN 3

Line 31, "a" should read --the--.

Line 32, "the" (second occurrence) should read --a--.

COLUMN 4

Line 22, "croculomb/g." should read --cro-coulomb/g.--.

UNITED STATES PATENT AND TRADEMARK OFFICE

CERTIFICATE OF CORRECTION

PATENT NO. : 5,223,900 Page 2 of 3

DATED : June 29, 1993

INVENTOR(S) : TAKAYASU YUMINAMOCHI, ET AL.

It is certified that error appears in the above-indentified patent and that said Letters Patent is hereby corrected as shown below:

COLUMN 5

Line 25, "(v > 40)." should read --(v $\geq$ 40)limited--.

Line 46, "has-been" should read --has been--.

Line 66, "line" should read --line:--.

Line 67, "$\log_{10}(R) = -9.16 \times 10^{-3} \times V_{-3} + 9.34$ (a)" should read --$\log_{10}(R) = -9.16 \times 10^{-3} \times v + 9.34$ (a)--

COLUMN 6

Line 20, "$\log_{10}(R \times L) = 9.16 \times 10^{-3} \times v + 11.68 \pm 0.65$ (1)" should read --$\log_{10}(R \times L) = -9.16 \times 10^{-3} \times v + 11.68 \pm 0.65$ (1)--

Line 29, "visiocsity" should read --velocity--.

Line 43, "$\log_{10}(R) = -9.16 \times 10^{-3} \times v + 9.34 - 0.65$" should read $\log_{10}(R) = -9.16 \times 10^{-3} \times v + 9.34 + 0.65$--.

Line 52, "of L " should read --is L --.

Line 63, "$\log_{10}(RL) = -0.16 \times 10^{-3} \times v + 11.68 + 0.65$" should read --$\log_{10}(RL) = -9.16 \times 10^{-3} \times v + 11.68 + 0.65$--

UNITED STATES PATENT AND TRADEMARK OFFICE

CERTIFICATE OF CORRECTION

PATENT NO. : 5,223,900 Page 3 of 3

DATED : June 29, 1993

INVENTOR(S) : TAKAYASU YUMINAMOCHI, ET AL.

It is certified that error appears in the above-indentified patent and that said Letters Patent is hereby corrected as shown below:

COLUMN 7

Line 38, "If" (2nd occurrence) should read --is--.

COLUMN 8

Line 5, "the" should be deleted.

Signed and Sealed this

Seventh Day of June, 1994

Bruce Lehman

*Attest:*

BRUCE LEHMAN

*Attesting Officer*

*Commissioner of Patents and Trademarks*